United States Patent [19]

Chaillou

[11] Patent Number: 4,871,998

[45] Date of Patent: Oct. 3, 1989

[54] POSTURE BELT

[76] Inventor: Michel B. Chaillou, 10746 N. Magnolia Ave., Santee, Calif. 92071

[21] Appl. No.: 248,498

[22] Filed: Sep. 23, 1988

[51] Int. Cl.[4] ..... G08B 23/00

[52] U.S. Cl. ..... 340/573; 340/575; 340/686; 340/689; 128/782; 200/DIG. 2; 200/61.52

[58] Field of Search ..... 340/573, 575, 686, 689; 128/782; 200/DIG. 2, 61.52

[56] References Cited

U.S. PATENT DOCUMENTS

| | | | |
|---|---|---|---|
| 3,608,541 | 9/1971 | Hall | 340/573 |
| 3,670,320 | 6/1972 | Palmer | 340/573 |
| 4,007,733 | 2/1977 | Celeste et al. | 340/573 |
| 4,191,949 | 3/1980 | Meyers | 340/573 |
| 4,227,189 | 10/1980 | Davis | 340/573 |
| 4,392,126 | 7/1983 | Loxola | 340/573 |

*Primary Examiner*—Donnie L. Crosland
*Attorney, Agent, or Firm*—Charles C. Logan, II

[57] ABSTRACT

A posture belt which is worn on the body of the user to remind the user to maintain good posture. The posture belt has a buzzer housing and an elongated belt. One end of the belt is detachably connected to the buzzer housing and the other end of the belt is connected to structure for actuating the buzzer alarm that forms part of the buzzer alarm circuit mounted within the buzzer housing. The buzzer alarm is actuated when the belt of the invention is distended due to improper posture. An adjustable time delay feature is incorporated into the wiring circuit that permits the user to select a few moments delay before the buzzer alarm is actuated.

5 Claims, 2 Drawing Sheets

POSTURE BELT

BACKGROUND OF THE INVENTION

The invention relates to a belt and more specifically to a posture belt designed to train its wearer to assume a good posture at all times.

Good posture is important, but unfortunately many people do not maintain a proper stance which is conducive to good health and appearance. Overweight people often find it difficult to maintain proper posture. Persons injured will tend to favor a postion which may not be the best for proper healing or therapy. Senior citizens tire more quickly and may tend to slouch which is injurious to vertebrae of the back. Proper posture, even while sitting at a desk, is important. Proper posture can conserve energy and make a worker more productive as well as maintaining an alert appearance. Applicant's posture belt is an electromechanical device which will offer a subtle constant reminder to the wearer when good posture is not being maintained. The posture belt is harmless to the wearer and is worn under the normal outer wear and out of sight. Users of the device will proclaim that the posture belt provides a means of maintaining good posture and they will derive the good health benefits resulting from good posture.

There is a need for a simple posture device which can be worn under the person's outer garments. Applicant's device will permit the user to select OFF, LOW, and HIGH positions for buzzer sound. Use of the instant invention will benefit the wearer by subtly reminding him when good posture is violated. Soon good posture will become a habit to the wearer and the good health and appearance benefits will accrue to its owner.

SUMMARY OF THE INVENTION

Applicant's novel posture belt is worn on the body of the user to remind him to maintain good posture. The device is normally worn about the waist, but it is not limited to the waist, as it could also be worn about the upper chest area. The purpose of the invention is to audibly inform the wearer whenever the belt of the invention is distended due to improper posture.

The posture belt is comprised of an elongated belt and a buzzer housing. One end of the belt is detachably connected to one of the side walls of the buzzer housing. The other end of the belt is connected to the buzzer alarm actuating means which itself is a component of the buzzer alarm circuit mounted within the buzzer housing.

The belt itself has structure which allows its length to be shortened or lengthened to accomodate the waist size of different users. A plurality of connecting snaps are mounted on the outside surface of the belt at predetermined locations. A pair of shoulder straps may be connected to the respective snaps on the outside surface of the belt and the posture belt may be worn about the chest of the user. Alternatively crotch straps can be attached to the connecting snaps when the posture belt is worn around the waist of the user. These straps are optional and are worn only where the user deems it necessary or when it may be more comfortable. Once attached to the wearer, the posture belt is capable of sounding an alarm or buzzer when the wearer assumes a stance or posture which is incorrect. A slouching posture causes the midriff to bulge whereupon the belt will be stretched and cause the buzzer to sound and thus remind the wearer to resume his correct posture. For momentary delay of the buzzer actuation, the invention includes a time delay feature which allows momentary distortion of the belt without actuating the buzzer alarm.

The posture belt accomplishes its buzzer alarm function by means of an electronic buzzer, powered by batteries and actuated by spring controlled contact points that close the buzzer alarm circuit. In the normal wearing position, the spring contact points are separated and the electrical connection for the buzzer is not made. Upon slouching or the assuming of an improper posture position, the midriff bulges, causing the belt to tighten on the waist line of the wearer. As the tension increases, the springs of the invention are extended. When the springs stretch the two electrical contact points meet and the electrical circuit is complete. The electricity flows from the batteries through its circuit and the contact points to the buzzer alarm. The buzzer alarm sounds, either loud or soft depending upon the position of the buzzer control switch, and the wearer is reminded that he is slouching or he is assuming an improper posture position. When the correct posture is resumed, the springs will pull the contact points apart, thus breaking the electrical connection and silencing the buzzer.

In order to prevent the buzzer alarm from actuating purely from the simple act of taking a deep breath or sneezing, the belt itself has a small area of elastic material which will allow a small deviation to be absorbed. However a slouch or grevious lapse in proper position will cause the springs of the invention to stretch and contact will be made to sound the buzzer alarm. The adjustable electrical delay timer is further used to buffer infractions. When beyond the maximum timer setting the buzzer will sound. Should the wearer, for any reason, want to temporarily silence the reminder buzzer alarm, the wearer simply moves the selector button to the off position and the unit will not actuate. This would be necessary to avoid wearer embarrasment when in meetings or other situations.

DESCRIPTION OF THE PREFERRED EMBODIMENT

Applicant's novel posture belt will now be described by referring to FIGS. 1–7 of the drawings. The posture belt is generally designated numeral 10.

Figure 3:
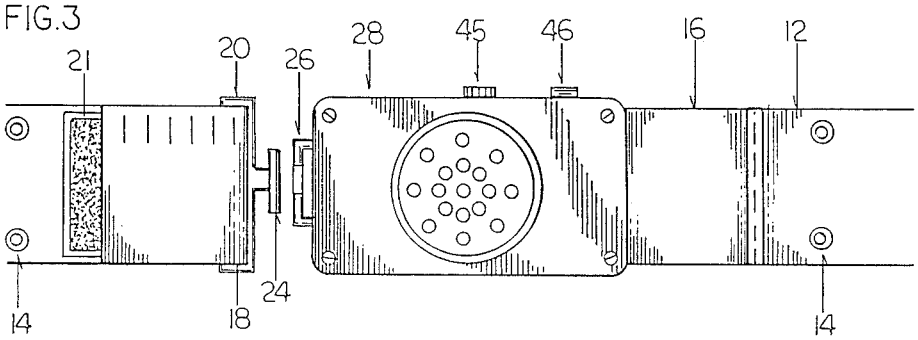
FIG. 3 is a partial elevation view of the latching structure and structure for lengthening and shortening the belt.
Figure 4:
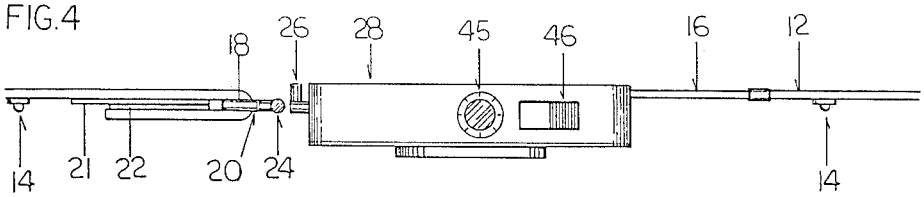
FIG. 4 is a top plan view of the portion of the belt illustrated in FIG. 3.

Posture belt 10 has an elongated belt 12 having a predetermined number of connecting snaps 14 mounted on its outside surface at predetermined locations. The function of these connecting snaps will be discussed later. Posture belt 12 is preferrably made of soft cotton material. One end of belt 12 has an elastic section 16 whose function is to absorb momentary stretching of the belt due to coughing, sneezing or the like. The other end of the belt has structure for lengthening and shortening the length of the belt to accommodate the different sized waists of persons wearing the belt. This structure is best illustrated in FIGS. 3 and 4. It is seen in these figures that one end of the belt 12 is looped through an elongated slot 18 in buckle 20 and folded back upon itself so that the mating hook and loop fastener structures 21 and 22 can easily be attached and detached from one another. There are numerical notations for different waist dimensions on the belt itself so that the person can easily adjust the belt to his own personal waist dimension. Buckle 20 has a protrusion 24 extending from its forward end that mates with a slot 26 formed in buzzer housing 28.

Figure 1:
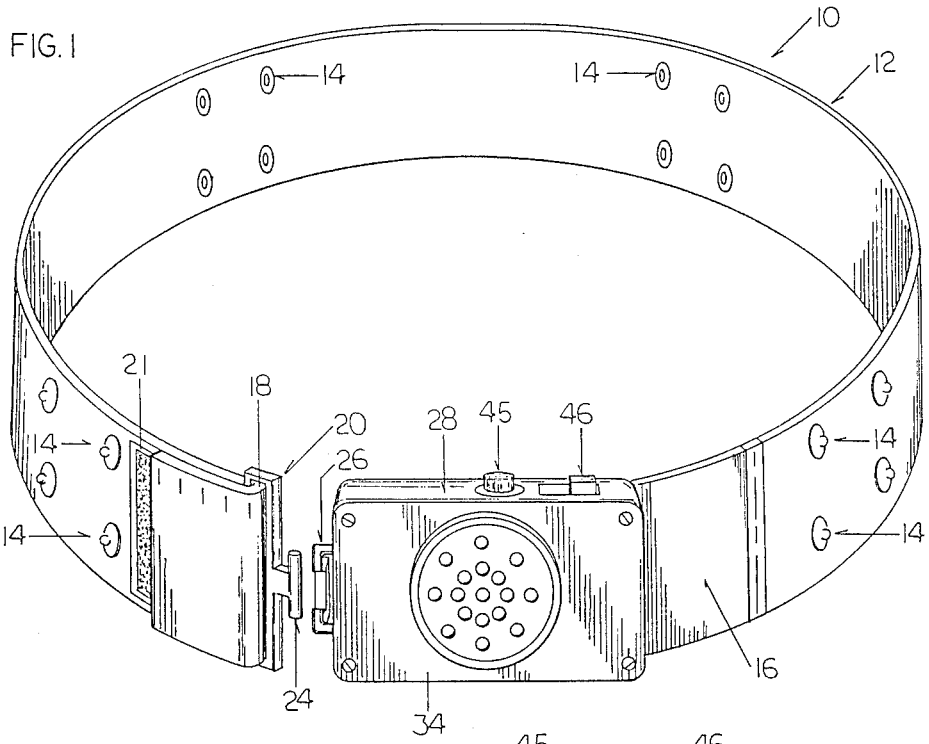
FIG. 1 is a front perspective view of applicant's novel posture belt.
Figure 2:
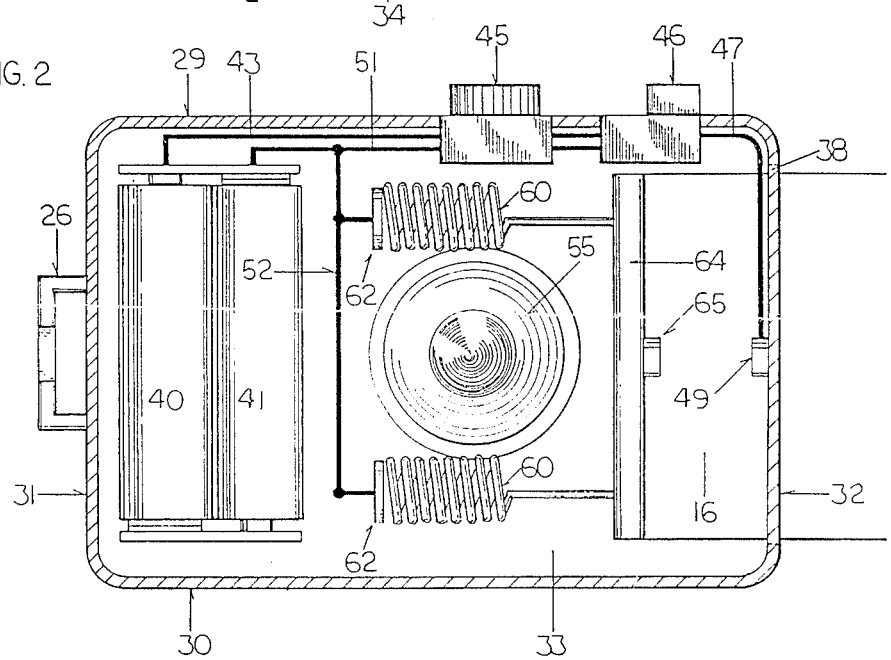
FIG. 2 is a vertical cross sectional view taken through the buzzer housing.

Referring to FIG. 2, buzzer housing 28 will now be described. It has a top wall 29, a bottom wall 30, a left side wall 31, a right side wall 32, a rear wall 33 and a detachable front wall 34. A receptacle 26 extends from left side wall 31 and it captures the neck portion of buckle protrusion 24. A slot 38 is formed in side wall 32 and the end of elastic section 16 passes therethrough into the interior of buzzer housing 28. Within buzzer housing 28 is mounted the buzzer alarm circuit. This circuit is comprised of batteries 40 and 41 that are connected in series, electrical wire 43 that is connected to delay timer 45 and then to sliding buzzer control switch 46 which in turn is connected to electrical wire 47 that is connected to stationary contact 49. Wire 51 is connected between the batteries and delay timer switch 45 sliding buzzer control switch 46. Electrical wire 52 is connected to coil spring anchors 62. Coil springs 60 have their one ends secured to anchors 62 and their opposite ends attached to end plate 64 that has movable contact 65 thereon. When the person wearing the posture belt 10 slouches or assumes an improper posture, his waist will expand causing the belt 12 to draw movable contact 65 into contact with stationary contact 49 thereby closing the buzzer alarm circuit which sounds the alarm speaker 55 (see FIG. 7).

Figure 5:
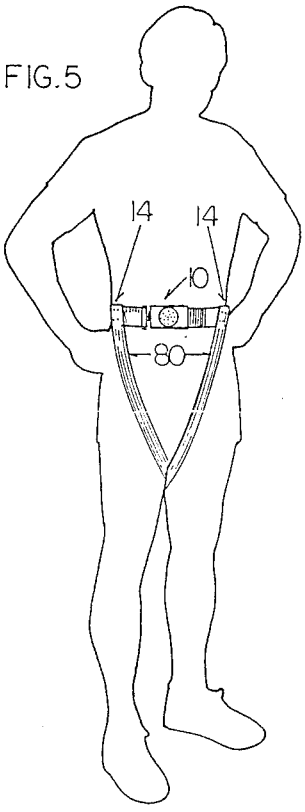
FIG. 5 is a perspective view illustrating the posture belt worn on a person and the use of crotch straps.
Figure 6:
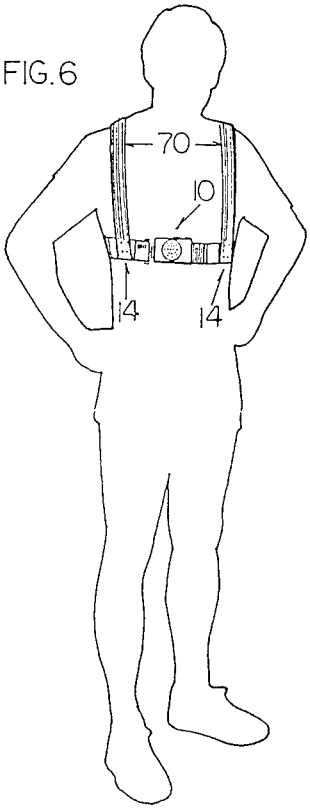
FIG. 6 is a perspective view of a person wearing the posture belt around their chest and using the shoulder strap.
Figure 7:
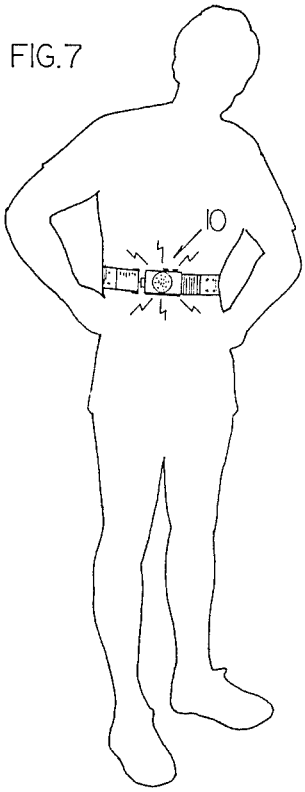
FIG. 7 is a perspective view illustrating the person wearing the posture belt and sounding the alarm buzzer when they have assumed an improper posture.

In FIG. 6 posture belt 10 has shoulder straps 70 attached to connecting snaps 14 and the belt is worn around the wearer's chest. In FIG. 5 the belt 10 has crotch straps 80 attached to connecting snaps 14.

What is claimed is:

1. A posture belt comprising:

a buzzer housing having an upright rear wall, a top wall, a bottom wall, a left side wall, a right side wall, a removable front wall and means for fastening said front wall to said buzzer housing, a first slot is formed in said buzzer housing adjacent one of its side walls for detachably receiving buckle fastening sturcture;

an elongated belt having a predetermined length and predetermined height, said belt having a first end and a second end, a buckle having a forward end is attached to the first end of said belt, said buckle has a protrusion extending form its forward end and it is detachably received in said first slot formed in said buzzer housing;

said belt having an elastic section whose function is to absorb momentary stretching of the belt due to coughing, sneezing or the like;

a second slot is formed in said buzzer housing in one of its side walls and it has a height larger than the height of said belt so that it may freely pass in and out of said second slot due to the expansion of the waist of the person wearing said belt;

a buzzer alarm circuit having electric battery power therein mounted within said buzzer housing, an adjustable delay timer is also connected in said circuit that permits the user to select a few moments delay before the buzzer alarm is actuated; and buzzer alarm actuating means connected to said second end of said belt, said buzzer alarm actuating means is also a component of said buzzer alarm circuit, said buzzer alarm actuating means comprising a pair of horizontally oriented coil springs each having a first end and a second end, said coil springs being vertically spaced from one another, the first ends of said coil springs being secured to their own anchors, the second ends of said springs being connected to a common vertically oriented end plate that is secured to one end of said elastic section, a removable contact terminal is mounted on said end plate and it is oriented toward a stationary terminal positioned on the inside wall surface of one of the end walls of said buzzer housing.

2. A posture belt as recited in claim 1 further comprising a plurality of snaps mounted at predetermined positions on the outside surface of said belt.

3. A posture belt as recited in claim 2 further comprising a pair of shoulder straps connected to the respective snaps on the outside surface of said belt.

4. A posture belt as recited in claim 2 further comprising a pair of crotch straps connected to the respective snaps on the outside surface of said belt.

5. A posture belt as recited in claim 1 further comprising means for lengthening and shortening the length of said belt to accommodate the different sized waists of persons wearing said belt.

* * * * *